US008382020B2

(12) United States Patent
Su

(10) Patent No.: US 8,382,020 B2
(45) Date of Patent: Feb. 26, 2013

(54) STRENGTHENED CUTTING DEVICE FOR A CROSSCUT SHREDDER

(76) Inventor: Chao-Lung Su, Taipei (TW)

( * ) Notice: Subject to any disclaimer, the term of this patent is extended or adjusted under 35 U.S.C. 154(b) by 230 days.

(21) Appl. No.: 12/911,960

(22) Filed: Oct. 26, 2010

(65) Prior Publication Data

US 2012/0097778 A1 Apr. 26, 2012

(51) Int. Cl.
*B02C 18/18* (2006.01)

(52) U.S. Cl. ..... 241/100; 241/236

(58) Field of Classification Search ..... 241/100, 241/236

See application file for complete search history.

(56) References Cited

U.S. PATENT DOCUMENTS 4,944,462 A * 7/1990 Raterman et al. ..... 241/100
5,295,633 A * 3/1994 Kimbro et al. ..... 241/166
5,829,697 A * 11/1998 Kroger ..... 241/236
5,853,131 A * 12/1998 Cheng ..... 241/100
5,954,280 A * 9/1999 Kroger et al. ..... 241/166
6,113,017 A * 9/2000 Tsai ..... 241/236
6,250,574 B1 * 6/2001 Wu Huang ..... 241/36
6,966,513 B2 * 11/2005 Chang ..... 241/236
7,234,656 B1 * 6/2007 Lo ..... 241/34
7,677,483 B2 * 3/2010 Romanovich et al. ..... 241/100
7,753,301 B1 * 7/2010 Lo ..... 241/100
7,975,945 B1 * 7/2011 Lo ..... 241/166
8,128,013 B2 * 3/2012 Bartelt et al. ..... 241/236
8,157,014 B2 * 4/2012 Hariharan et al. ..... 166/357
2002/0100827 A1 * 8/2002 Ho ..... 241/100
2002/0195510 A1 * 12/2002 Lin ..... 241/236
2004/0135019 A1 * 7/2004 Chang ..... 241/236
2004/0262436 A1 * 12/2004 Lo ..... 241/236
2007/0215734 A1 * 9/2007 Tsai ..... 241/236
2011/0062263 A1 * 3/2011 Bartelt et al. ..... 241/236

* cited by examiner

*Primary Examiner* — Faye Francis
(74) *Attorney, Agent, or Firm* — C. G. Mersereau; Nikolai & Mersereau, P.A.

(57) ABSTRACT

A cutting device for a crosscut shredder is mounted in a housing, is driven by a motor through a transmission gear set and has two driving shafts, and two bracing leaves, multiple shredding blades and multiple partitions mounted on the driving shafts. The partitions are disposed between the shredding blades. The bracing leaves hold the driving shafts at middles of the driving shafts to structurally enhance the driving shafts so the driving shafts are not deformed easily. Therefore, the papers are shredded thoroughly, and the transmission gear set and the motor are able to operate appropriately and keep in good conditions. Moreover, the driving shafts have saved manufacturing costs and effective shredding capabilities.

4 Claims, 5 Drawing Sheets

STRENGTHENED CUTTING DEVICE FOR A CROSSCUT SHREDDER

BACKGROUND OF THE INVENTION

1. Field of the Invention

The present invention relates to a cutting device for a crosscut shredder, especially to a cutting device that is strengthened to avoid deformation.

2. Description of the Prior Art(s)

A shredder shreds private, confidential or sensitive documents or files into small pieces to render information thereon unreadable. A conventional shredder has a cutting device mounted in a housing. The cutting device has two driving shafts, multiple shredding blades and multiple partitions. The driving shafts are parallelly mounted rotatably on the housing, are driven by a motor through a gear set and are rotated toward opposite directions. The shredding blades are mounted securely on the driving shafts and are rotated along with the driving shafts. The partitions are mounted on the driving shafts and disposed between the shredding blades to keep the shredding blades from hitting each other.

However, the conventional shredder has the following disadvantages. Since the driving shafts are disposed on the housing only with their ends mounted rotatably on the housing, when the conventional shredder shreds a stack of paper at a time, the driving shafts, especially middles of the driving shafts, are pulled by the stack of paper and are deformed easily. Thus, the papers are not shredded completely, and the ends of the driving shafts disengage from the gear set or push the gear set so the gear set and the motor break down. A conventional way to avoid deformation of the driving shaft is to increase thickness of the driving shafts and/or making the driving shafts with tough materials. However, manufacturing costs are also increased.

To overcome the shortcomings, the present invention provides a strengthened cutting device for a crosscut shredder to mitigate or obviate the aforementioned problems.

SUMMARY OF THE INVENTION

The main objective of the present invention is to provide a strengthened cutting device for a crosscut shredder. The cutting device is mounted in a housing, is driven by a motor through a transmission gear set and has two driving shafts, and two bracing leaves, multiple shredding blades and multiple partitions mounted on the driving shafts. The partitions are disposed between the shredding blades. The bracing leaves hold the driving shafts at middles of the driving shafts to structurally enhance the driving shafts so the driving shafts are not deformed easily. Therefore, the papers are shredded thoroughly, and the transmission gear set and the motor are able to operate appropriately and keep in good conditions. Moreover, the driving shafts have saved manufacturing costs and effective shredding capabilities.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
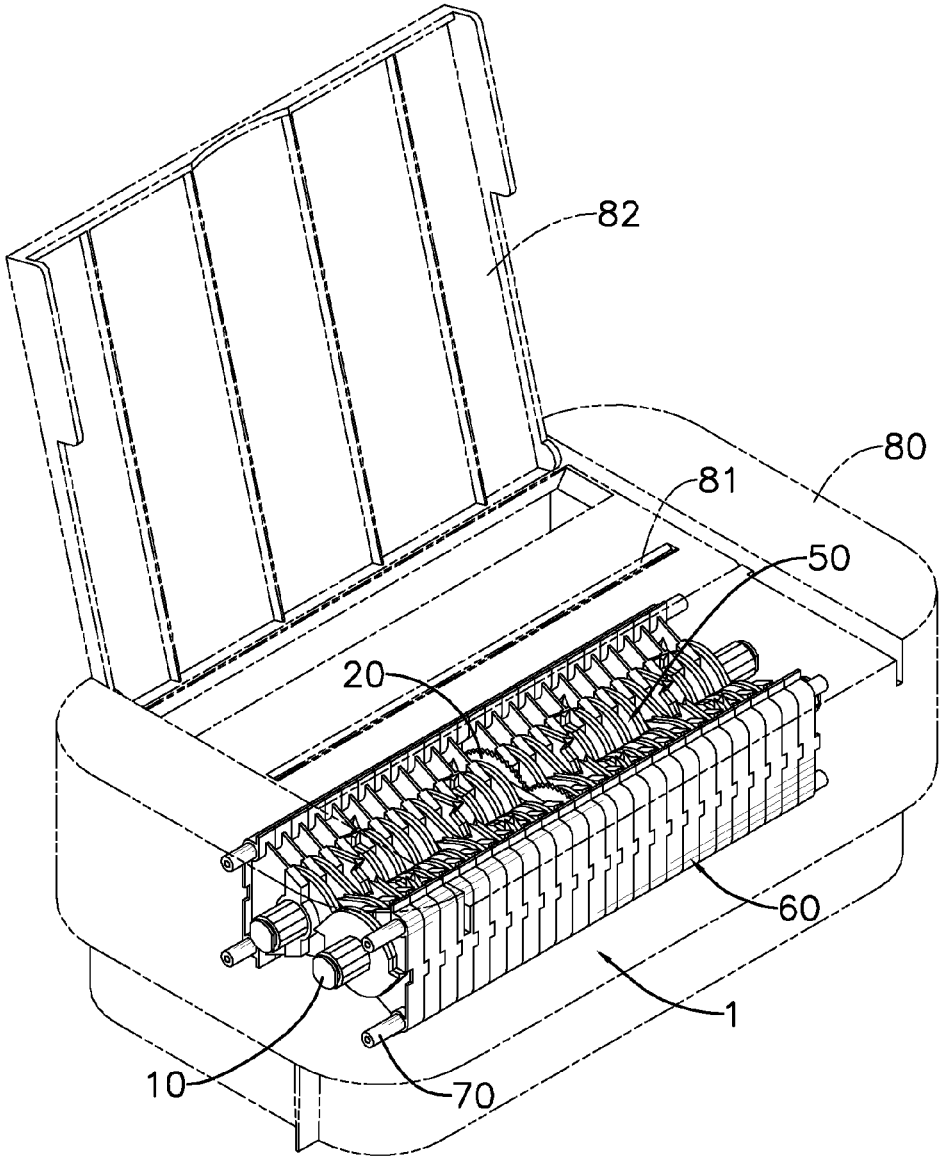
FIG. 1 is a perspective view of a strengthened cutting device for a crosscut shredder in accordance with the present invention, shown mounted in a housing of the crosscut shredder.

With reference to FIG. 1, a crosscut shredder has a housing 80, and a cutting device 1 in accordance with the present invention, a motor and a transmission gear set mounted in the housing 80. The housing 80 has an entrance 81, an exit and a slide 82. The entrance 81 is formed through a top of the housing 80. The exit is formed through a bottom of the housing 80. The slide 82 is mounted obliquely on the top and corresponds to the entrance 81 of the housing 80.

Figure 2:
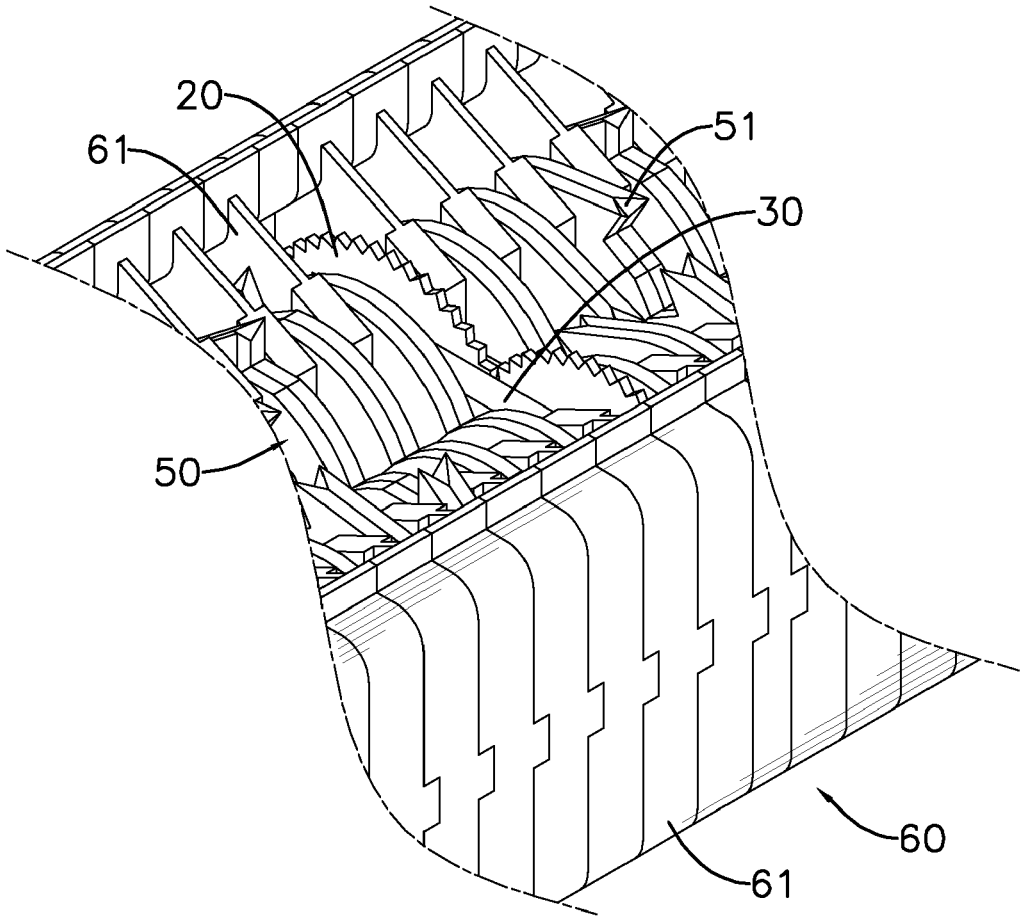
FIG. 2 is an enlarged perspective view of the strengthened cutting device in FIG. 1.
Figure 3:
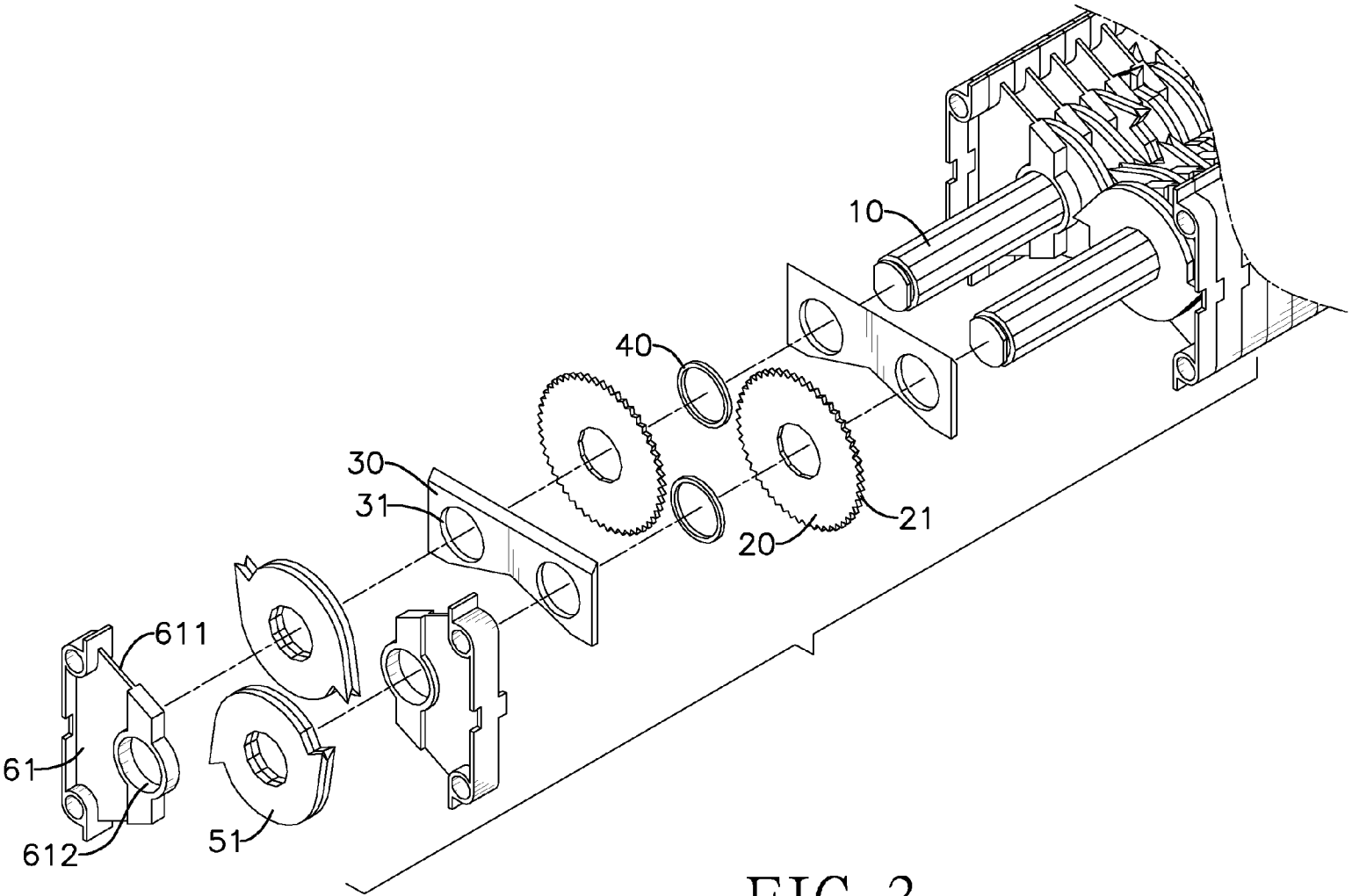
FIG. 3 is an enlarged partial exploded perspective view of the strengthened cutting device in FIG. 1.

With further reference to FIGS. 2 and 3, the cutting device 1 in accordance with the present invention is disposed between the entrance 81 and the exit of the housing 80 and comprises two driving shafts 10, two splitting blades 20, two bracing leaves 30, two gaskets 40, two shredding sets 50, two partition sets 60 and multiple supporting rods 70. The driving shafts 10 are mounted rotatably in the housing 80 and are parallel to each other.

Figure 4:
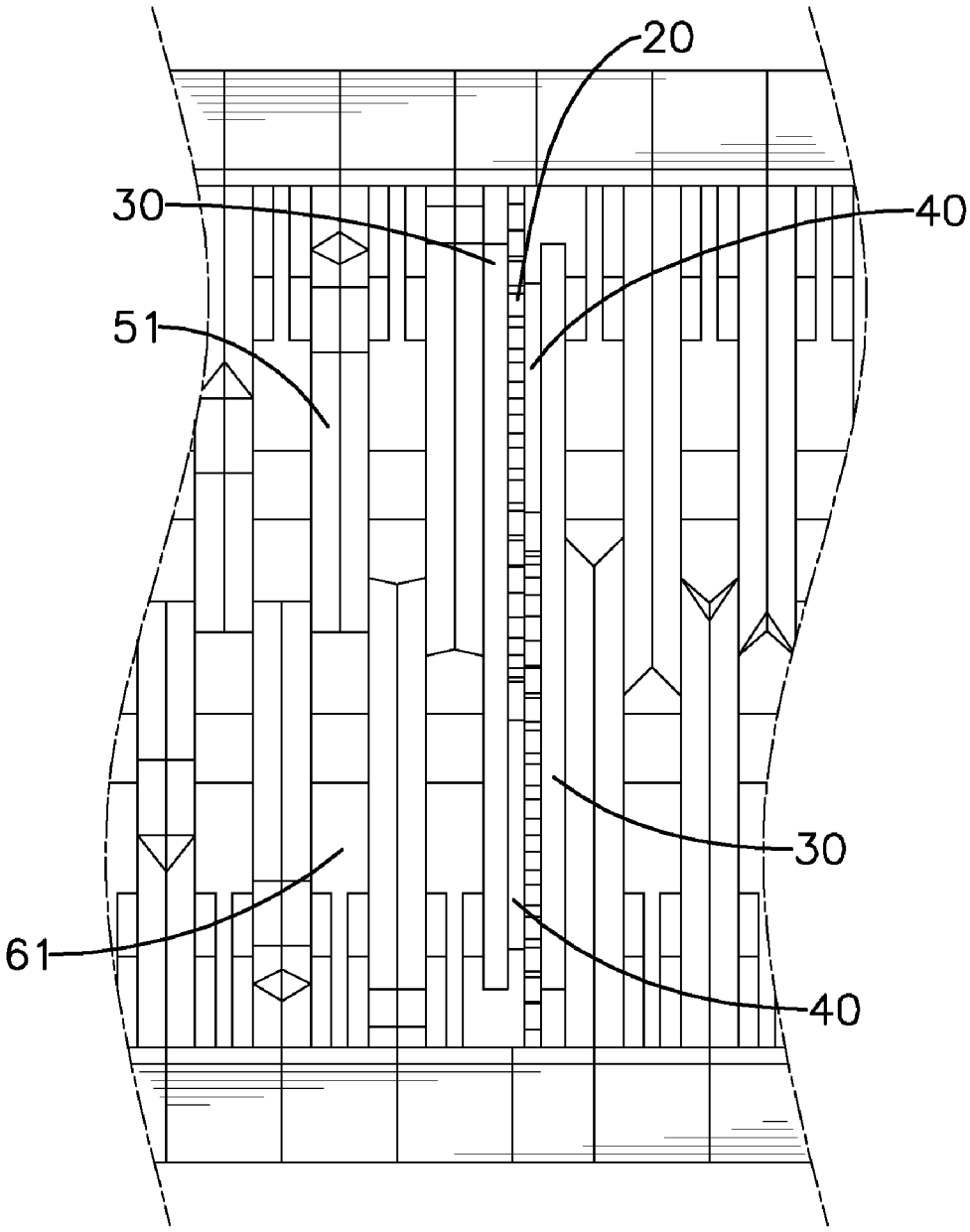
FIG. 4 is an enlarged top view of the strengthened cutting device in FIG. 1.
Figure 5:
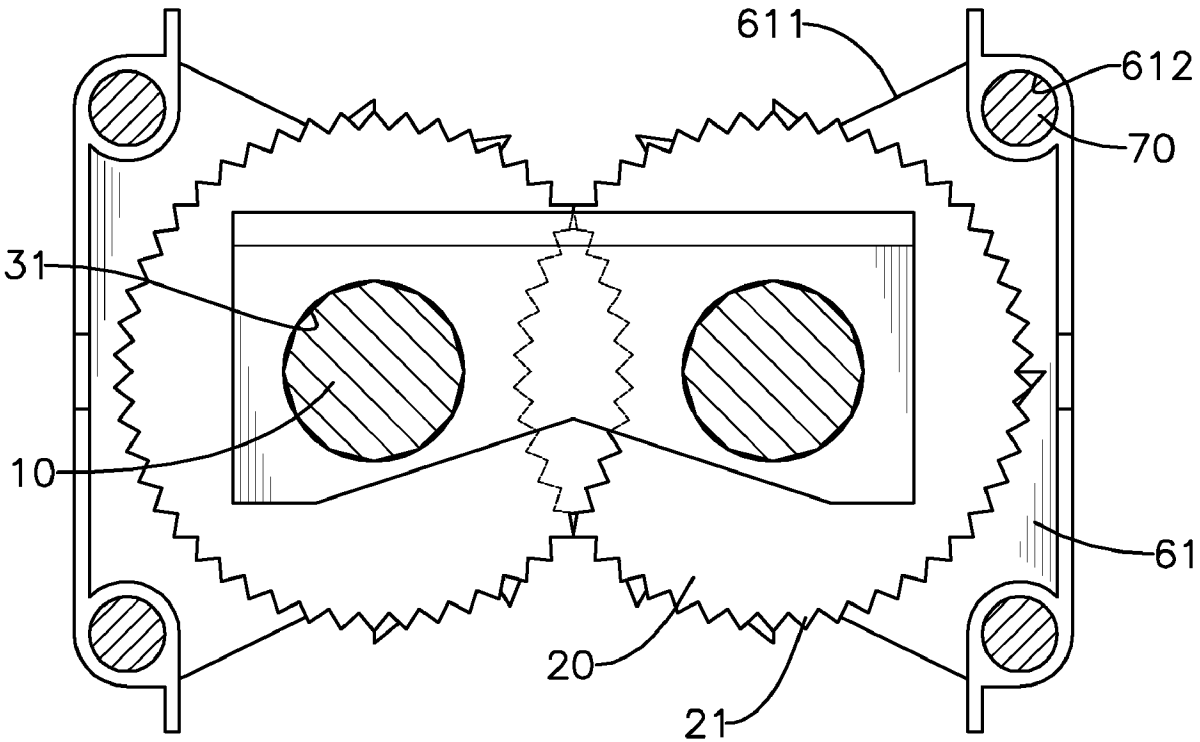
FIG. 5 is an enlarged cross-sectional side view of the strengthened cutting device in FIG. 1.

With further reference to FIGS. 4 and 5, the splitting blades 20 are respectively mounted securely on the driving shafts 10, are adjacent to middles of the driving shafts 10 and are offset to each other. Each splitting blade 20 has multiple teeth 21 formed around a peripheral edge of the splitting blade 20.

The bracing leaves 30 are mounted respectively on the driving shafts 10, are adjacent to the middles of the driving shafts 10 and are disposed respectively beside the splitting blades 20. Each bracing leaf 30 has two mounting holes 31 mounted respectively around the driving shafts 10. Thus, the driving shafts 10 held by the bracing leaves 30 do not easily deform.

The gaskets 40 are circular and are mounted respectively around the driving shafts 10. Each gasket 40 is disposed between one bracing leaf 30 and one of the splitting blades 20 that is mounted on the same driving shaft 10 and aligns with the other one of the splitting blades 20 that is mounted on the other driving shaft 10.

The shredding sets 50 are mounted respectively around the driving shafts 10. Each shredding set 50 has multiple shredding blades 51. The shredding blades 51 are separately mounted securely around a corresponding driving shaft 10 and are disposed between the bracing leaves 30 and ends of the driving shaft 10. The shredding blades 51 of one shredding set 50 are arranged staggeringly with the shredding blades 51 of the other shredding set 50.

The partition sets 60 are mounted respectively around the driving shafts 10. Each partition set 60 aligns with a corresponding shredding set 50 and has multiple partitions 61. The partitions 61 are mounted around a corresponding driving shaft 10. Each partition 61 is disposed between two adjacent shredding blades 51 of the corresponding shredding set 50 and has an inner side, an upper edge 611 and multiple through holes 612. The inner side of the partition 61 corresponds to the aligning shredding blade 51. The upper edge 611 of the partition 61 is inclined from an outer side of the partition 61 to the inner side of the partition 61. The through holes 612 are formed through the partition 61. Each through hole 612 of the partitions 61 of one partition set 60 aligns with each other.

The supporting rods 70 are mounted respectively through aligning through holes 612 of the partitions 61 of the partition sets 60 and are mounted securely on the housing 80 so the cutting device 1 is held firmly in the housing 80.

The transmission gear set connects the driving shafts 10 to the motor. Thus, when the motor operates, the driving shafts 10, the splitting blades 20 and the shredding blades 51 of the shredding sets 50 rotate simultaneously.

As a stack of paper is mounted on the slide 82 of the housing 80 and slides through the entrance 81 of the housing 80 and along the inclined upper edge 611 of the partition 61, the splitting blades 20 cut each paper into two halves first and then the shredding blades 51 shred the half papers into small pieces later.

The cutting device 1 for a crosscut shredder as described has following advantages. The bracing leaves 30 that hold the driving shafts 10 at the middles of the driving shafts 10 structurally enhance the driving shafts 10 so the driving shafts 10 are not deformed easily. Therefore, the papers are shredded thoroughly, and the transmission gear set and the motor are able to operate appropriately and keep in good conditions. Moreover, the driving shafts 10 that are enhanced without increasing their thickness and making with tough materials have saved manufacturing costs and effective shredding capabilities.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A strengthened cutting device for a crosscut shredder comprising two driving shafts being parallel to each other;

two bracing leaves mounted respectively on the driving shafts and being adjacent to middles of the driving shafts, and each bracing leaf having two mounting holes mounted respectively around the driving shafts;

two splitting blades respectively mounted securely on the driving shafts, disposed between the bracing leaves and being offset to each other, and each splitting blade having multiple teeth formed around a peripheral edge of the splitting blade;

two gaskets being circular and mounted respectively around the driving shafts, and each gasket disposed between one bracing leaf and one of the splitting blades that is mounted on the same driving shaft and aligning with the other one of the splitting blades that is mounted on the other driving shaft;

two shredding sets mounted respectively around the driving shafts, and each shredding set having multiple shredding blades mounted securely around a corresponding driving shaft and disposed between the bracing leaves and ends of the driving shafts, and the shredding blades of one shredding set arranged staggeringly with shredding blades of the other shredding set; and two partition sets mounted respectively around the driving shafts, and each partition set aligning with a corresponding shredding set and having multiple partitions mounted around a corresponding driving shaft, and each partition disposed between two adjacent shredding blades of the corresponding shredding set.

2. The cutting device as claimed in claim 1, wherein each partition of the partition set has multiple through holes formed through the partition, and each through hole of the partitions of one partition set aligns with a through hole in another partition set;

the cutting device further comprises multiple supporting rods mounted respectively through aligning through holes of the partitions of the partition sets.

3. The cutting device as claimed in claim 2, wherein each partition of each partition set has an inner side corresponding to the aligning shredding blade; and an upper edge inclined from an outer side of the partition to the inner side of the partition.

4. The cutting device as claimed in claim 1, wherein each partition of each partition set has an inner side corresponding to the aligning shredding blade; and an upper edge inclined from an outer side of the partition to the inner side of the partition.

* * * * *